US005203820A

United States Patent [19]

Dibbs

[11] Patent Number: 5,203,820

[45] Date of Patent: Apr. 20, 1993

[54] FOOD FREEZING APPARATUS

[75] Inventor: Richard J. Dibbs, Huron, Ohio

[73] Assignee: Frigoscandia Food Process Systems AB, Helsingborg, Sweden

[21] Appl. No.: 847,409

[22] Filed: Mar. 6, 1992

[51] Int. Cl.[5] ..... F25D 125/02

[52] U.S. Cl. ..... 62/381; 62/63

[58] Field of Search ..... 62/381, 63

[56] References Cited

U.S. PATENT DOCUMENTS 3,884,213 5/1975 Smith .
4,054,861 10/1977 Markison .
4,338,911 7/1982 Smith .
4,462,383 7/1984 Henke et al. .
4,474,498 10/1984 Smith .
4,479,776 10/1984 Smith .
4,523,391 6/1985 Smith et al. .
4,612,780 9/1986 Briley et al. ..... 62/381
4,679,542 7/1987 Smith et al. .
4,750,276 6/1988 Smith et al. .
4,875,343 10/1989 Jeppsson ..... 62/381
4,953,365 9/1990 Lang et al. ..... 62/381

*Primary Examiner*—Ronald C. Capossela
*Attorney, Agent, or Firm*—Browdy and Neimark

[57] ABSTRACT

An apparatus for freezing of food products comprises an insulated housing, an endless, foraminous conveyor belt following a helical path for forming a belt pile having several tiers in the housing, and helical rail means for supporting the conveyor belt at one side thereof along the helical path. Cooled air is circulated through the belt pile. Nozzles for ejecting cooled, pressurized air are positioned between the tiers of the belt pile, such that a plurality of air jets are ejected from the nozzles for impinging upon both a top side and a bottom side of food products carried by the conveyor belt past the nozzles.

6 Claims, 1 Drawing Sheet

FOOD FREEZING APPARATUS

BACKGROUND OF THE INVENTION

This invention relates to an apparatus for freezing of food products.

There are several types of freezers known for the freezing of food products. For example, using a liquid gas, such as liquid nitrogen, in a bath or as sprays, provides for quick freezing. This method is normally only practiced for small volumes of food products. When freezing larger volumes of food products, cold air is preferred. However, using high velocity jets of air does not either lend itself to freezing of large volumes of food products.

SUMMARY OF THE INVENTION

Therefore, an object of the present invention is to provide an improved freezing apparatus adequate for freezing large volumes of food products.

Another object of the present invention is to provide such a freezing apparatus which is compact and adaptable to various food products.

The objects of this invention are obtained in an apparatus for freezing food products which comprises an insulated housing; an endless, foraminous conveyor belt following a helical path for forming a belt pile having several tiers in said housing; helical rail means for supporting the conveyor belt at one side thereof along the helical path; cooling means; airflow means for circulating an airflow through said cooling means and said belt pile in series; duct mean positioned between the tiers of said belt pile and extending along at least a part of said helical path from the beginning thereof, said duct means having a top wall and a bottom wall each having a plurality of nozzles therein; a chamber connected to said duct means along that side of the belt pile where said helical rail means supports the conveyor belt and having an opening towards said cooling means for receiving cooled air therefrom; and impeller means for drawing the cooled air into said chamber and increasing the air pressure in said chamber and in said duct means such that a plurality of air jets are ejected from the nozzles in said duct means for impinging upon both a top side and a bottom side of food products carried by the conveyor belt past said duct means.

The helical design of the conveyor belt path is advantageous by being compact. Using the present invention, the size of the apparatus could be further reduced since the quick freezing using air jets reduces the required length of the helical path.

Also, the helical design of the conveyor belt path is very well adapted for combining with high velocity air nozzles as these are easily installed between the tiers of the belt pile such that both sides of the food products being carried by the foraminous conveyor belt are exposed.

Further, the helical design of the belt conveyor is effective in that the chamber connecting the nozzles to the outlet side of the air cooler may be compact and thus pressure losses are small.

In a preferred embodiment, the endless conveyor belt is self-supporting at the side thereof not supported by the rail means. Such an endless conveyor belt is disclosed in U.S. Pat. No. 4,858,750 to Keith Cawley and assigned to Frigoscandia Contracting AB, Sweden. The disclosure of this patent is incorporated herein by reference.

Alternatively, the helical rail means may support the conveyor belt at both sides thereof, as disclosed in U.S. Pat. No. 3,348,659 to G. C. Roinestad. The disclosure of this patent is also incorporated herein by reference.

Preferably, the duct means extends only along a part of the helical path, thereby defining a first, quick freezing zone followed by a second, finish-freezing zone.

Independent of the length of the duct means along the helical path, blocking means may be provided for adjusting the effective length of the duct means, i.e. the length of that part thereof being connected to the chamber.

DESCRIPTION OF PREFERRED EMBODIMENTS

Figure 1:
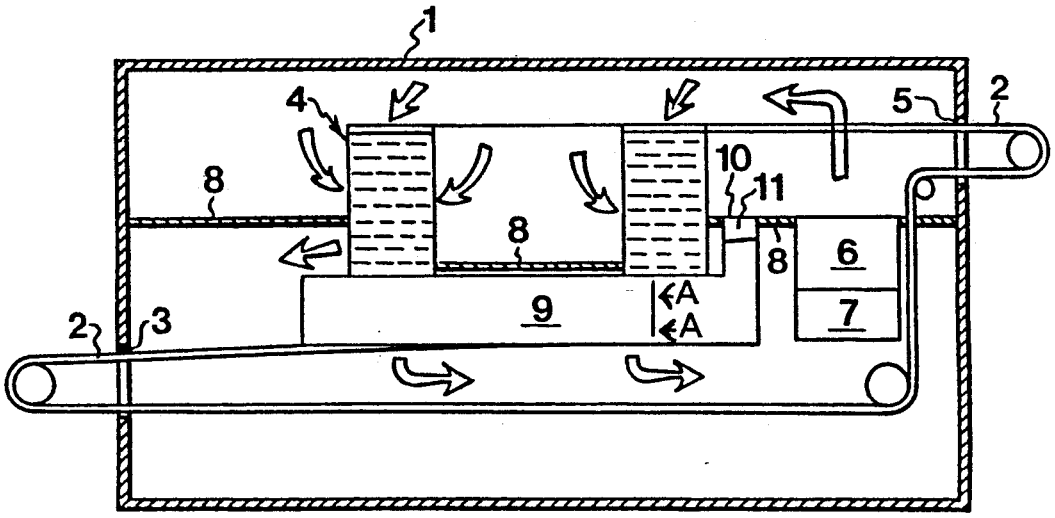
FIG. 1 is a schematic sectional view of an embodiment of a freezing apparatus according to the present invention.

In FIG. 1, there is shown a freezing apparatus having an insulated housing 1. An endless, foraminous conveyor belt 2 is guided from outside the housing 1 through an opening 3 therein. Inside the housing 1 the conveyor belt 2 follows a helical path in several tiers such that a belt pile 4 is formed. Further, the conveyor belt 2 leaves the housing 1 through a second opening 5 therein and then returns, partly through the housing 1, back to outside the opening 3.

The housing 1 contains cooling means in the form of an evaporator 6, through which air is blown by a fan 7, such that an air flow is generated circulating through the evaporator 6 and the belt pile 4 in series, cf. the arrows in FIG. 1. In order to confine the air flow to this path, partitions 8 are provided inside and outside of the belt pile 4, as shown in FIG. 1.

Details of a conveyor belt that could be used in the apparatus according to the present invention, are given in the above referenced U.S. Pat. No. 4,858,750. Alternative conveyor belts are shown in U.S. Pat. Nos. 3,348,659 and 4,078,655 to G. C. Roinestad.

Encircling the lower part of the belt pile 4, there is an annular chamber 9 having an inlet opening 10 towards the outlet side of the evaporator 6 and containing an impeller or fan 11 for drawing cooled air into the chamber 9 in order to raise the air pressure therein. The chamber 9 communicates with a duct 12 having a substantially rectangular cross-section. This duct 12 is positioned between the tiers of the conveyor belt 2 in a first part of the helical path thereof. Thus, the duct 12 is in the form of a helix and it has a top wall and a bottom wall. Nozzles 13 are formed in these walls of the duct 12 so as to eject jets of air towards the top and bottom sides of food products carried by the conveyor belt 2, cf. FIG. 2. Details of the effect of such air jets are disclosed in U.S. Pat. No. 3,884,213 to D. P. Smith. The disclosure of this patent is incorporated herein by reference.

Figure 2:
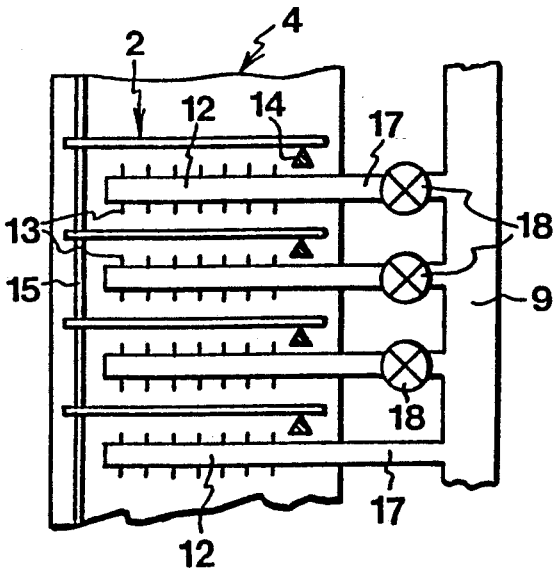
FIG. 2 is a partial, sectional view along section A—A of FIG. 1 showing details of the apparatus in FIG. 1

In FIG. 2, the conveyor belt 2 is supported by guide rails 14 at the radially outer side of the belt pile 4 while at the radially inner side thereof the belt 2 is self-supporting by having spacer elements 15 carrying the belt in the overlying tier. Such a belt is described in detail in the above-referenced U.S. Pat. No. 4,858,750.

Figure 3:
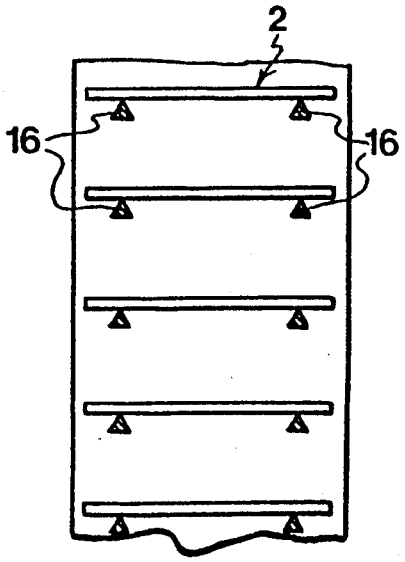
FIG. 3 is a partial view like that in FIG. 2 illustrating an alternative embodiment of part of the apparatus in FIG. 1.

As an alternative, the belt could be supported at both its sides by guide rails 16, as illustrated in FIG. 3 and detailed in the above-referenced U.S. Pat. No. 3,348,659.

The connection between the annular chamber 9 and the duct 12 may have several forms. It could be continous or consist of several channels, e.g. one or more channels 17 for each turn of the duct 12 corresponding to one tier of the belt 2. In the latter case, the duct 12 could be divided into several sections by partitions, such that by blocking, e.g. by separate valves 18, one or more channels could be closed.

It is appreciated, that such blocking enables adjustment of the effective length of the duct 12 and therefore adjustment of the relative lengths of a quick freezing zone and a following finish-freezing zone of the apparatus according to the present invention.

Various modifications of the above-described and illustrated embodiments are possible within the scope of the invention as defined in the appended claims. For example, the guide rails 14, 16 could be supported by the duct means 12, as shown in FIG. 2.

What is claimed is:

1. An apparatus for freezing of food products, comprising:

an insulated housing;

an endless, foraminous conveyor belt following a helical path for forming a belt pile having several tiers in said housing;

helical rail means for supporting the conveyor belt at one side thereof along the helical path;

cooling means;

air flow means for circulating an air flow through said cooling means and said belt pile in series;

duct means positioned between the tiers of said belt pile and extending from a beginning of said helical path along at least a part of said helical path, said duct means having a top wall, a bottom wall and side walls, said top wall and said bottom wall having a plurality of nozzles therein;

a chamber connected to said duct means along that side of the belt pile where said helical rail means supports the conveyor belt and having an opening towards said cooling means for receiving cooled air therefrom; and impeller means for drawing the cooled air into said chamber and increasing the air pressure in said chamber and in said duct means such that a plurality of air jets are ejected from said plurality of nozzles in said duct means for impinging upon both a top side and a bottom side of food products carried by the conveyor belt past said duct means.

2. An apparatus as claimed in claim 1, wherein said endless conveyor belt is self-supporting at a side thereof not supported by said rail means.

3. An apparatus as claimed in claim 1, wherein said helical rail means supports said conveyor belt at both sides thereof.

4. An apparatus as claimed in claim 1, wherein said duct means defines a first quick freezing zone on a corresponding portion of said belt pile followed by a second finish-freezing zone defined by said belt pile after said at least part of said helical path occupied by said duct means.

5. An apparatus as claimed in claim 1, wherein said chamber is positioned on a radially outer side of said belt pile.

6. An apparatus as claimed in claim 1, further comprising blocking means located between said tiers of said belt pile for adjusting the operating length of said duct means being connected to said chamber.

* * * * *